US007699047B2

(12) United States Patent
Tippman, Jr. et al.

(10) Patent No.: US 7,699,047 B2
(45) Date of Patent: Apr. 20, 2010

(54) PAINTBALL MARKER WITH TOOL BOX

(75) Inventors: Dennis J. Tippman, Jr., Fort Wayne, IN (US); Bryce A. Carrico, Fort Wayne, IN (US); Jeffrey P. Douglas, Fort Wayne, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 46 days.

(21) Appl. No.: 12/016,370

(22) Filed: Jan. 18, 2008

(65) Prior Publication Data

US 2009/0120420 A1 May 14, 2009

Related U.S. Application Data

(60) Provisional application No. 60/880,989, filed on Jan. 18, 2007.

(51) Int. Cl.
*F41B 11/00* (2006.01)

(52) U.S. Cl. ..... 124/73; 124/1; 124/80

(58) Field of Classification Search ..... 124/56–77, 124/1, 80; 42/85, 95
See application file for complete search history.

(56) References Cited

U.S. PATENT DOCUMENTS

| | | | | |
|---|---|---|---|---|
| 4,299,343 | A * | 11/1981 | Atchisson | 224/149 |
| 5,383,442 | A * | 1/1995 | Tippmann | 124/76 |
| 6,536,152 | B1 * | 3/2003 | Wisz | 42/71.01 |
| 6,640,480 | B2 * | 11/2003 | Williams et al. | 42/95 |
| 2003/0136044 | A1 * | 7/2003 | Williams et al. | 42/95 |
| 2007/0181117 | A1 * | 8/2007 | Tippmann et al. | 124/74 |

* cited by examiner

*Primary Examiner*—Bret Hayes
(74) *Attorney, Agent, or Firm*—Barnes & Thornburg LLP

(57) ABSTRACT

A paintball marker with a barrel that is coupled to a receiver. A valve arrangement is provided to selectively vent gas to propel projectiles through the barrel responsive to actuation of a firing mechanism. The marker may include a tool box that is capable of being coupled with the receiver. In some embodiments, the tool box resembles a magazine that feeds projectiles into the receiver.

55 Claims, 21 Drawing Sheets

PAINTBALL MARKER WITH TOOL BOX

RELATED APPLICATION

The present application claims priority to U.S. Provisional Application No. 60/880,989, filed on Jan. 18, 2007, the entire disclosure of which is hereby incorporated by reference.

TECHNICAL FIELD

The present invention relates generally to paintball markers, and like devices for firing frangible projectiles.

BACKGROUND

Paintball is a popular sport in which opposing sides attempt to seek out and "shoot" one another with paintballs. Players use paintball markers (also known as paintball guns) to propel the paintballs with compressed gas or combustible fuel. The paintballs are designed to break upon impact and leave a visible mark.

Since paintball games often simulate combat, paintball markers that resemble military equipment are desirable to increase the realism of the experience. For example, paintball markers have been modified to resemble assault rifles, sniper rifles, etc. In some cases, however, such modifications can be difficult to install and remove. Moreover, the modifications may detract from the marker's functionality and reliability.

SUMMARY

According to one aspect, the invention provides a paintball marker with a barrel that is coupled to a receiver. A valve arrangement is provided to selectively vent gas to propel projectiles through the barrel responsive to actuation of a firing mechanism. The marker may include a tool box that is capable of being coupled with the receiver. Typically, the tool box resembles a magazine that feeds projectiles into the receiver. For example, the tool box could resemble an M-16 or AK-47 style magazine. In some embodiments, the tool box includes a storage compartment configured to hold one or more items for maintaining the marker.

According to another aspect, the invention provides a tool box for use with a paintball marker. The tool box may have a body with a proximate end capable of being detachably coupled with a receiver of a paintball marker and a distal end. In some embodiments, the body defines a storage compartment configured to hold one or more items for maintaining the marker.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The following description references the attached drawings which were given as non-limiting examples only, in which.

Corresponding reference characters indicate corresponding parts throughout the several views. The exemplifications set out herein are illustrative, and are not to be construed as limiting the scope of the invention in any manner.

DETAILED DESCRIPTION OF THE DRAWINGS

FIGS. 1-9 illustrate an example paintball marker 100 constructed according to an embodiment of the present invention. The invention could be implemented in a manual, semi-automatic, or automatic marker, even though a semi-automatic marker is shown for purposes of illustration. It should be appreciated that the marker 100 could use a variety of propellants to propel paintballs (or other projectiles) from the marker 100. The term "propellant" is broadly intended to encompass both compressed gas, such as carbon dioxide and nitrogen, as well as combustible fuel, such as propane, butane, and methylacetylene-propadiene ("MAPP").

In the example shown, the marker 100 includes a barrel 102 through which projectiles may be propelled. As shown, the barrel 102 is coupled with a receiver 104, which defines an interior cavity dimensioned to house internal components of the marker 100. As used herein, the term "coupled" is broadly intended to encompass both direct and indirect connections. Typically, the barrel 102 includes external threads that may be received by internal threads in the receiver 104. By way of other examples, the barrel 102 may attach to the receiver 104 with an interference fit, frictional fit, or unitary formation. The receiver 104 may be formed from a variety of materials, such as aluminum, stainless steel, magnesium, or composites. In embodiments in which the receiver 104 is made of magnesium, it has been found that the production molds last substantially longer than that of aluminum. In some embodiments, the receiver 104 may have a clamshell-type body.

Figure 7:
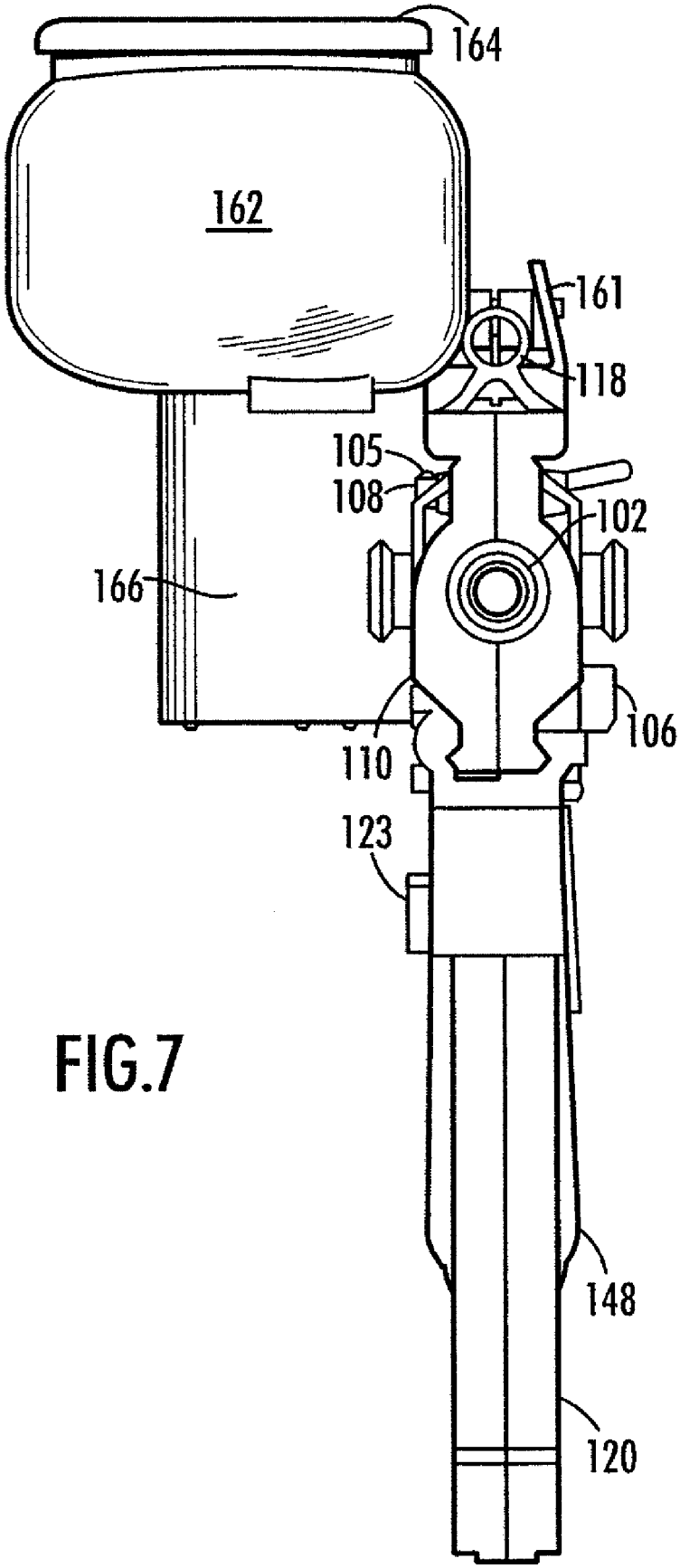
FIG. 7 is a front view of the example paintball marker shown in FIG. 1.
Figure 8:
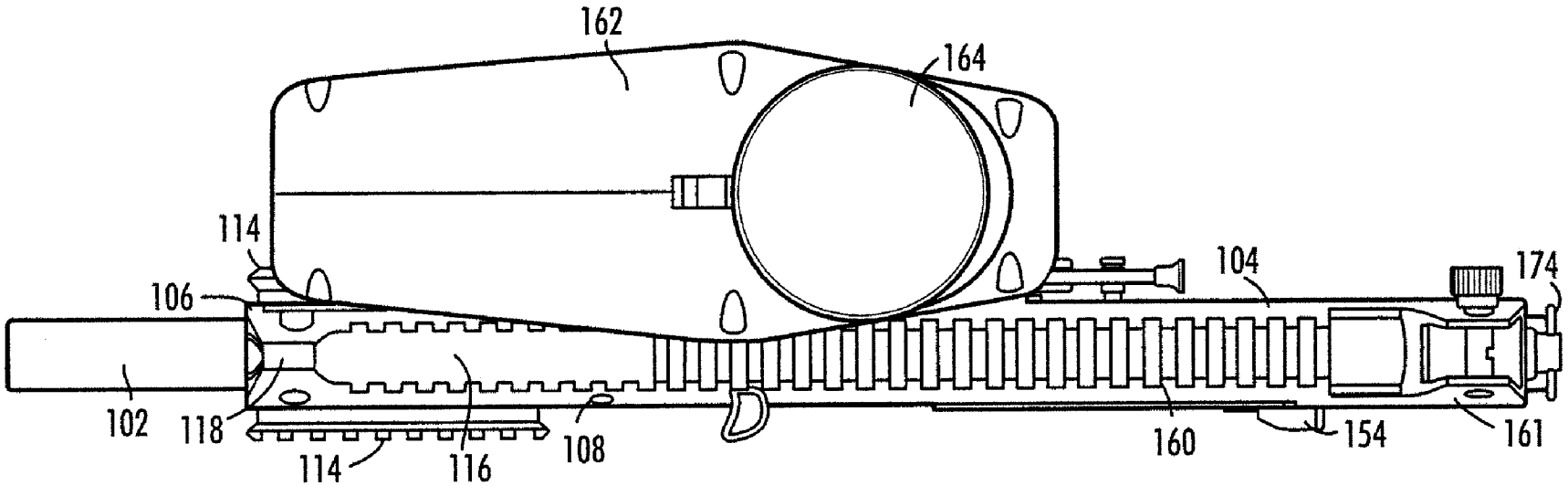
FIG. 8 is a top view of the example paintball marker shown in FIG. 1.
Figure 9:
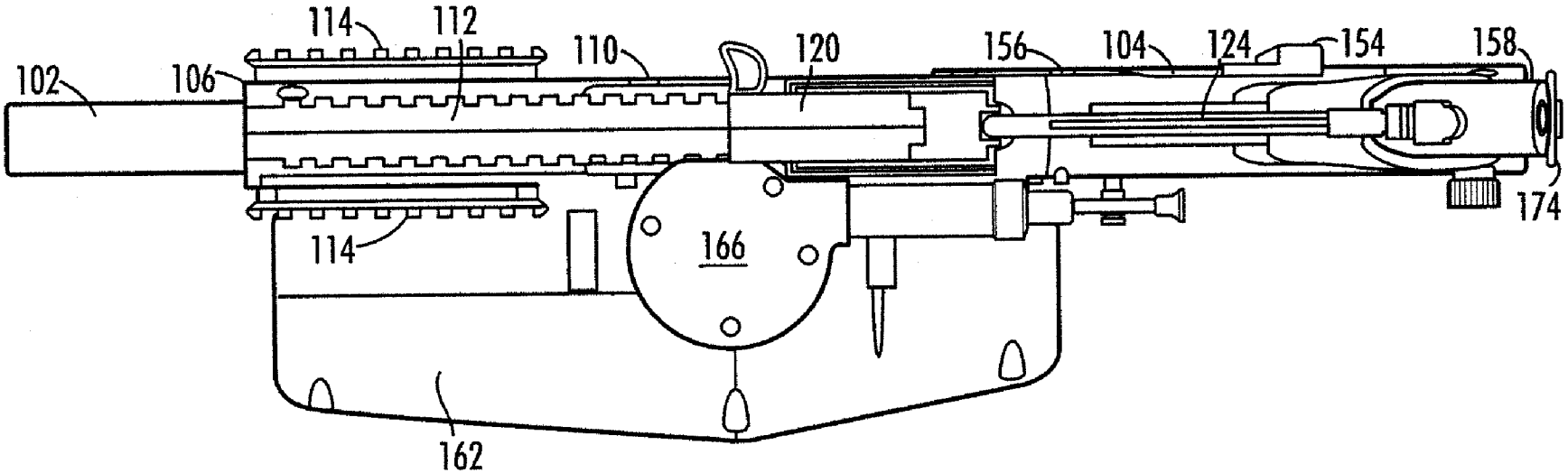
FIG. 9 is a bottom view of the example paintball marker shown in FIG. 1.
Figure 10:
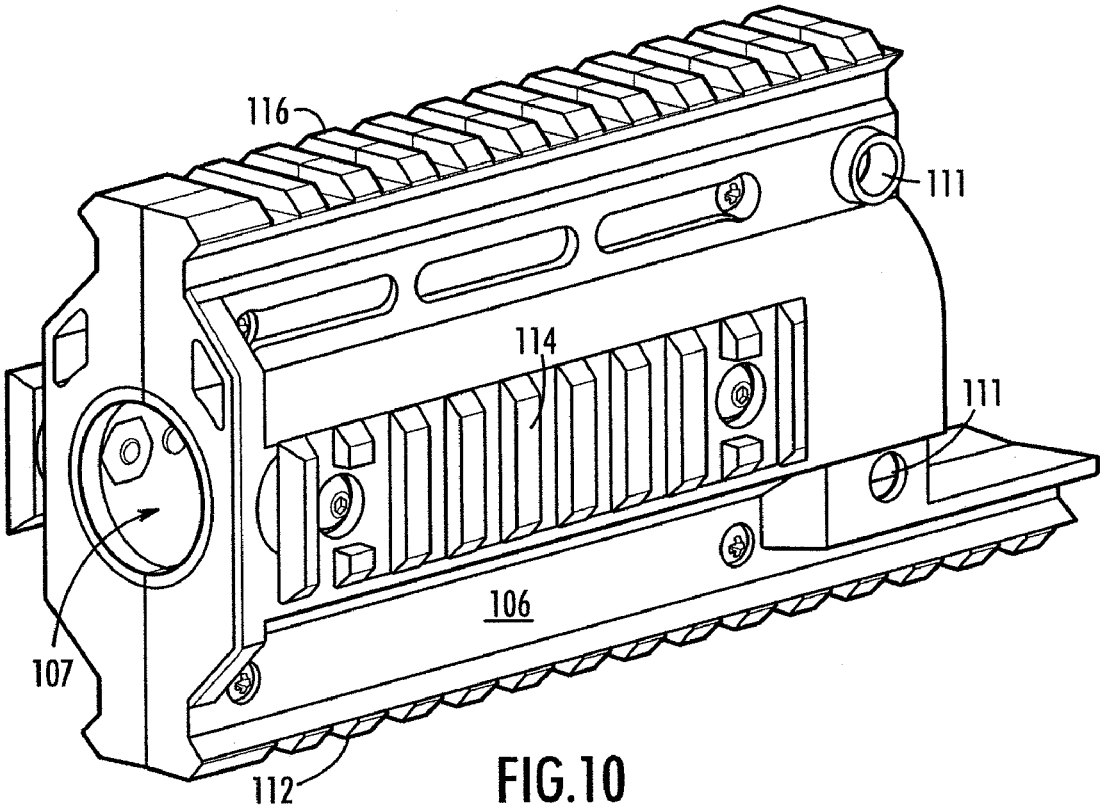
FIG. 10 is a detailed perspective view of the forestock shown in the example paintball marker of FIG. 1.
Figure 11:
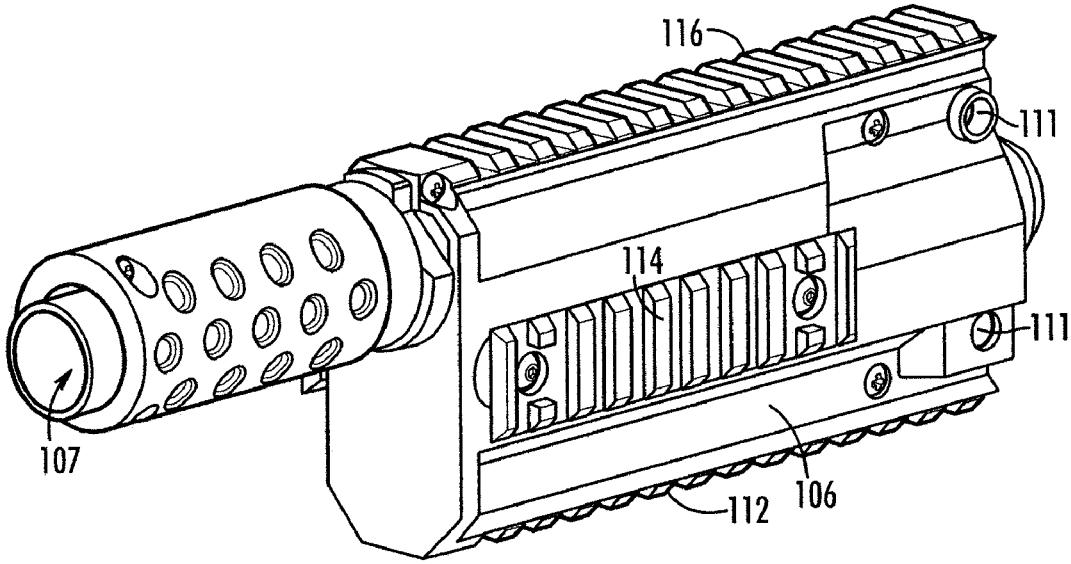
FIG. 11 is a detail perspective view of an alternative forestock that may be used with the example paintball of FIG. 1.
Figure 10A:
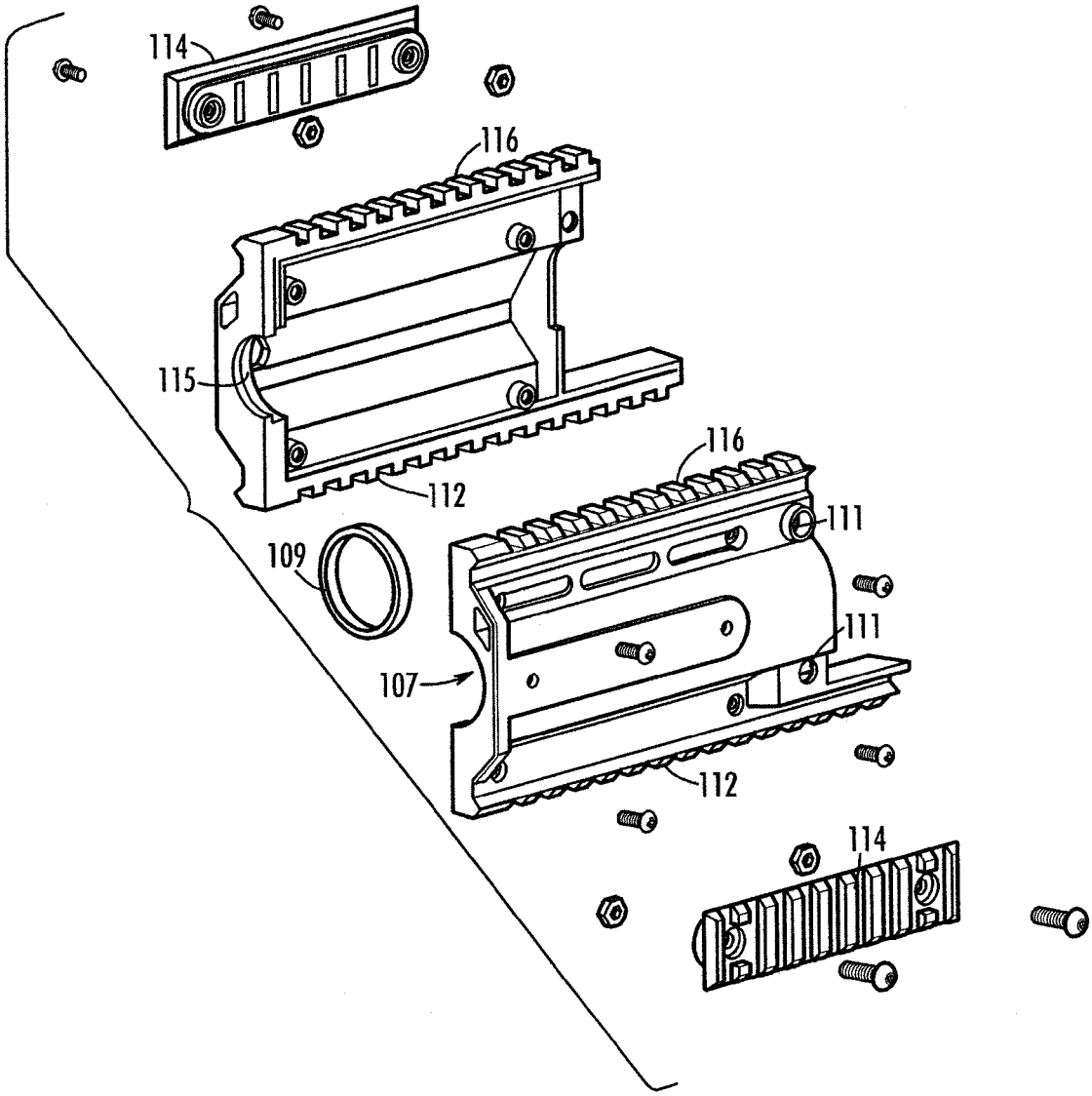
FIG. 10A is an exploded view of the forestock shown in FIG. 10.

In the embodiment shown, the marker 100 includes a forestock 106. As best seen in FIGS. 10 and 10A, the forestock 106 may include a bore 107 dimensioned to receive the barrel 102. Preferably, the forestock 106 may be detachably coupled to the receiver 104. In the example shown, a first pin 108 and a second pin 110 extend through holes 111 in the forestock 106 and holes 113 in the receiver 104 (FIG. 2), thereby coupling the forestock 106 to the receiver 104. In this example, the forestock 106 may be detached from the receiver 104 by removing the pins 108 and 110 and sliding the forestock 106 off the barrel 102. Conversely, a user may mount the forestock 106 to the marker 100 by sliding the forestock 106 over the barrel 102 such that the holes 111 in the forestock 106 and the holes 113 in the receiver 104 are aligned. The pins 108 and 110 may then be moved through the forestock 106 and receiver 104 to couple the forestock 106 to the receiver 104. As best seen in FIG. 7, the pins 108 and 110 may include a bias member 105 to prevent accidental removal of the pins 108 and 110. Although the first pin 108 and second pin 110 are shown for purposes of illustration, it should be appreciated that other quick connections may be used to couple the forestock 106 to the receiver 104.

In some cases, the forestock 106 may be associated with a barrel adapter 109. The barrel adapter 109 (best seen in FIG. 10A) allows a user to configure the marker 100 with barrels of different diameters. Consider a situation in which a user desires to use barrels with either a ⅞ inch diameter or a 1 inch diameter. The bore 107 could be dimensioned to receive the 1 inch barrel. If the ⅞ inch barrel is desired to be used, the user would place the barrel through the adapter 109. In this example, the opening in the adapter 109 would be dimensioned to receive the barrel, which is ⅞ inches in this example. The outer diameter of the adapter 109 would be dimensioned to be received by the bore 107, or 1 inch in this example. As shown, the adapter is received in a recess 115 formed in the forestock 106.

Figure 21A:
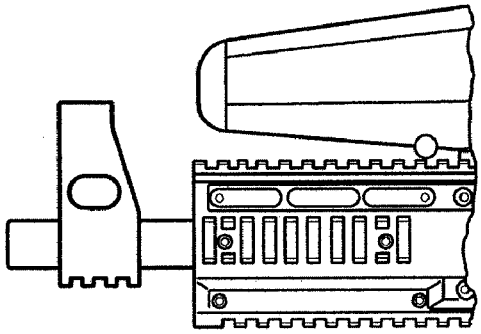
FIGS. 21A-21D show example front sights and handles that may be connected to the marker.
Figure 21B:
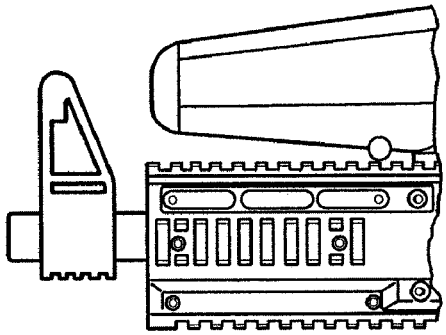
Figure 22:
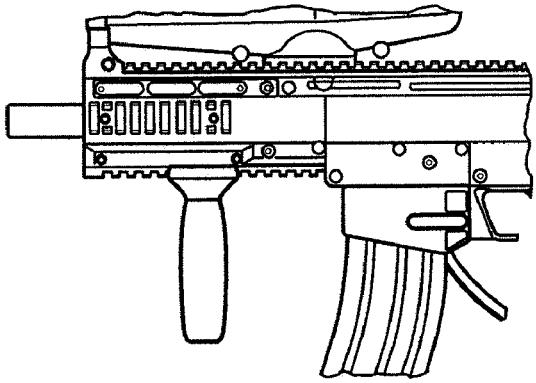
FIG. 22 shows an example vertical handle that may be connected to the marker.

In some embodiments, the forestock 106 may include a bottom rail 112, a side rail 114, and/or a top rail 116 for mounting accessories, such as sites, scopes, etc. In the example shown, the marker 100 includes a front site 118 mounted to the top rail 116. It should be appreciated that the marker 100 could be customized with other types of sites, such as those shown in FIGS. 21A-21B. By way of a further example, a vertical handle, such as shown in FIG. 22, could be attached to the bottom rail 112.

Preferably, the user may select between a plurality of interchangeable forestocks, which each allow a suitable quick connection with the receiver 104 to customize the marker 100. For example, if the receiver 104 includes holes 113, each of the forestocks could include holes 111 to allow a quick connection using pins 108 and 110. Example forestocks that could be used with the marker 100 are illustrated in FIGS. 19A-19E. It should be appreciated that other styles of forestocks could be used with the marker 100.

In some embodiments, the marker 100 may include a tool box 120 for storing one or more items. In this embodiment, the tool box 120 is coupled with and extends from the receiver 104. Typically, the tool box 120 is detachably coupled with the receiver 104; however, the tool box 120 could be integral with or permanently affixed to the receiver 104. Embodiments are also contemplated in which the tool box 120 could be an internal storage compartment in the receiver 104 that could be accessed by a user.

Preferably, the tool box 120 resembles a magazine that feeds projectiles into the receiver. Instead of feeding projectiles into the receiver 104, however, the tool box 120 would typically hold tools for maintaining the marker 100, including but not limited to hex wrenches or a tube of oil. As shown, the tool box 120 includes a slot 122 dimensioned to receive a first supply line 124. In other embodiments, the tool box 120 could include a connection for coupling the first supply line 124. Preferably, the first supply line 124 provides a source of compressed gas for a valve arrangement 178 within the marker 100 (see FIG. 13). In some cases, if the marker 100 were a combustible fuel powered marker, the first supply line 124 may provide a supply of fuel, such as propane, to a combustion chamber within the marker 100.

Figure 12:
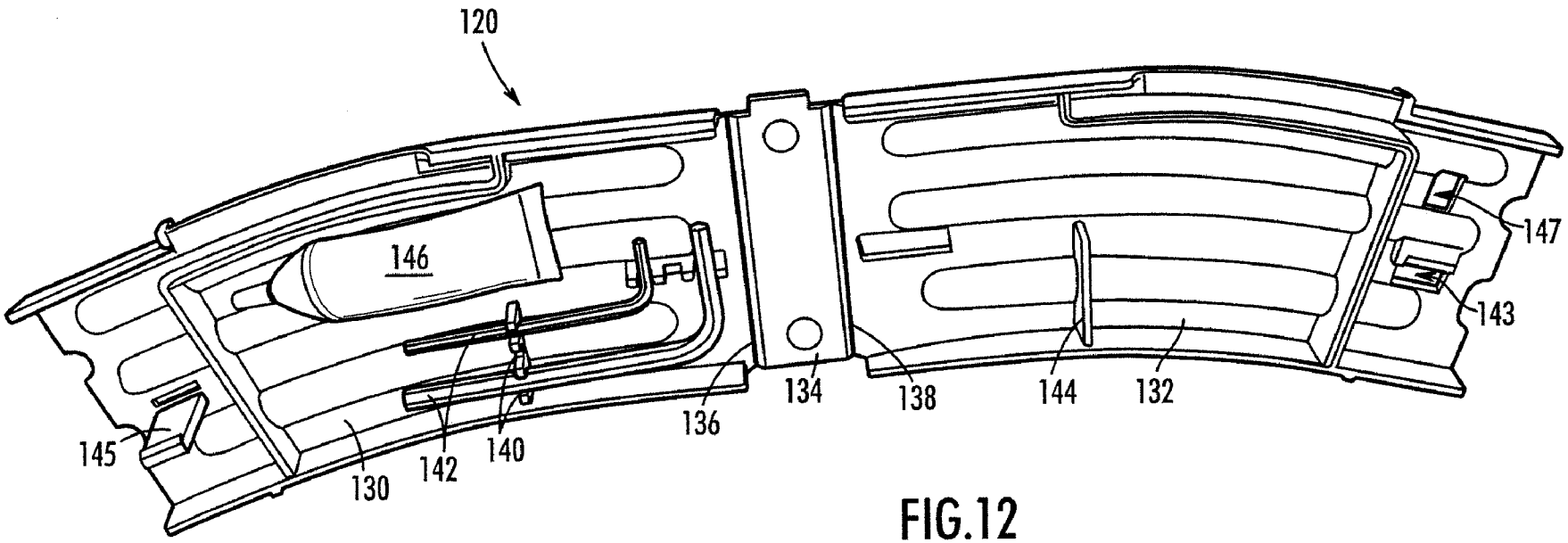
FIG. 12 is a perspective view of an example tool box constructed in accordance with the embodiment of the invention in which the tool box is in an open position to show items disposed therein.

The tool box 120 may include an internal storage compartment for storing items, such as tools. In the example shown in FIG. 12, the tool box 120 includes a first side 130 and a second side 132 pivotally coupled with a bottom 134. Although the embodiment shown includes an open top, the tool box 120 may be entirely closed since projectiles are not fed into the receiver 104 from the tool box 120 in this embodiment.

As shown, the tool box 120 includes a first hinge 136 and a second hinge 138 that allow the first side 130 and second side 132 to pivot, respectively. In this example, the hinges 136 and 138 are living hinges, but separate hinges could be coupled with the sides 130 and 132 and bottom 134 in some cases. It should be appreciated that other pivotal connections could also be used. Although this example shows the tool box 120 hinged at the bottom 134, it should be appreciated that the tool box 120 could be hinged at the sides 130 and 132 or the top or not hinged at all.

In some cases, the tool box's 120 interior may include tool holders configured to receive a specific arrangement of tools (or other items). In the example shown, the tool box 120 includes slots 140 dimensioned to receive hex wrenches 142 in the first side 130 of the tool box 120. The second side 132 includes complementary ridges 144 configured to close the slots 140 when the tool box 120 is closed, thereby holding the wrenches 142 in place. In this example, the first side 130 of the tool box 120 also includes an area for a tube of oil 146 that could be used to maintain the marker 100. It should be appreciated that the internal cavity of the tool box 120 could be configured to hold a variety of tools, accessories, or other items.

In the example shown, the tool box 120 includes an opening 143 dimensioned to receive an internal latch 145 when the tool box 120 is closed. In this example, the tool box 120 includes an opening 147 dimensioned to receive a latch mechanism in a tool box mount 121 for detachably coupling the tool box 120 to the receiver 104.

Referring again to FIGS. 1-9, the marker 100 preferably includes a tool box mount 121 configured to receive the tool box 120. As shown, the tool box mount 121 includes a release button 123 (best seen in FIG. 5) that controls a latch mechanism associated with the tool box mount 121. In the example shown, the latch mechanism engages the opening 147 in the tool box 120 to selectively release the tool box 120 from the tool box mount 121. It should be appreciated that a variety of mechanisms could be used to detachably couple the tool 120 with the tool box mount 121, such as an interference fit, fictional fit, magnets, etc.

Figure 1:
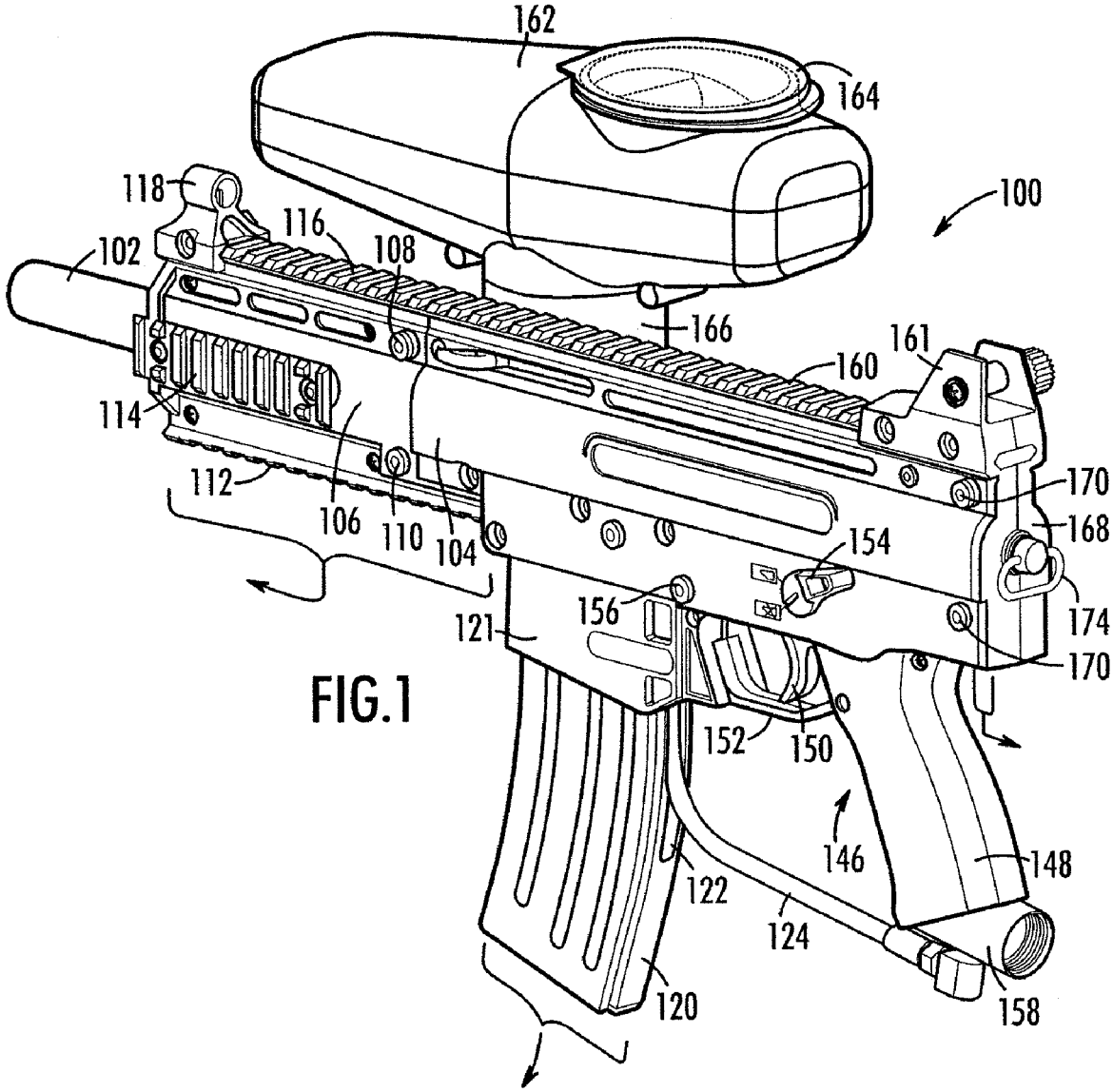
FIG. 1 is a perspective view of an example paintball marker constructed according with an embodiment of the present invention.
Figure 2:
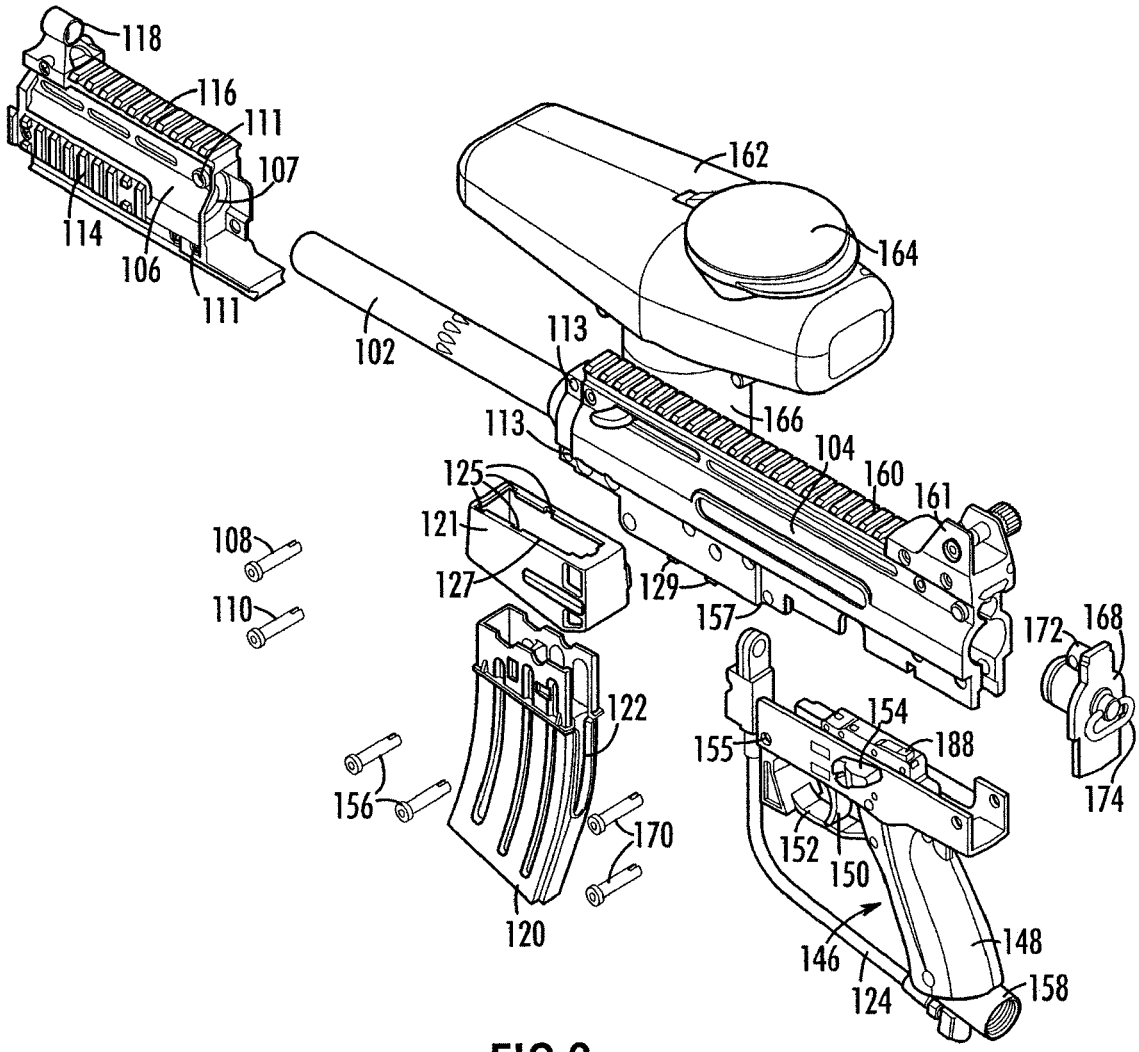
FIG. 2 is an exploded view of the example paintball marker shown in FIG. 1.
Figure 3:
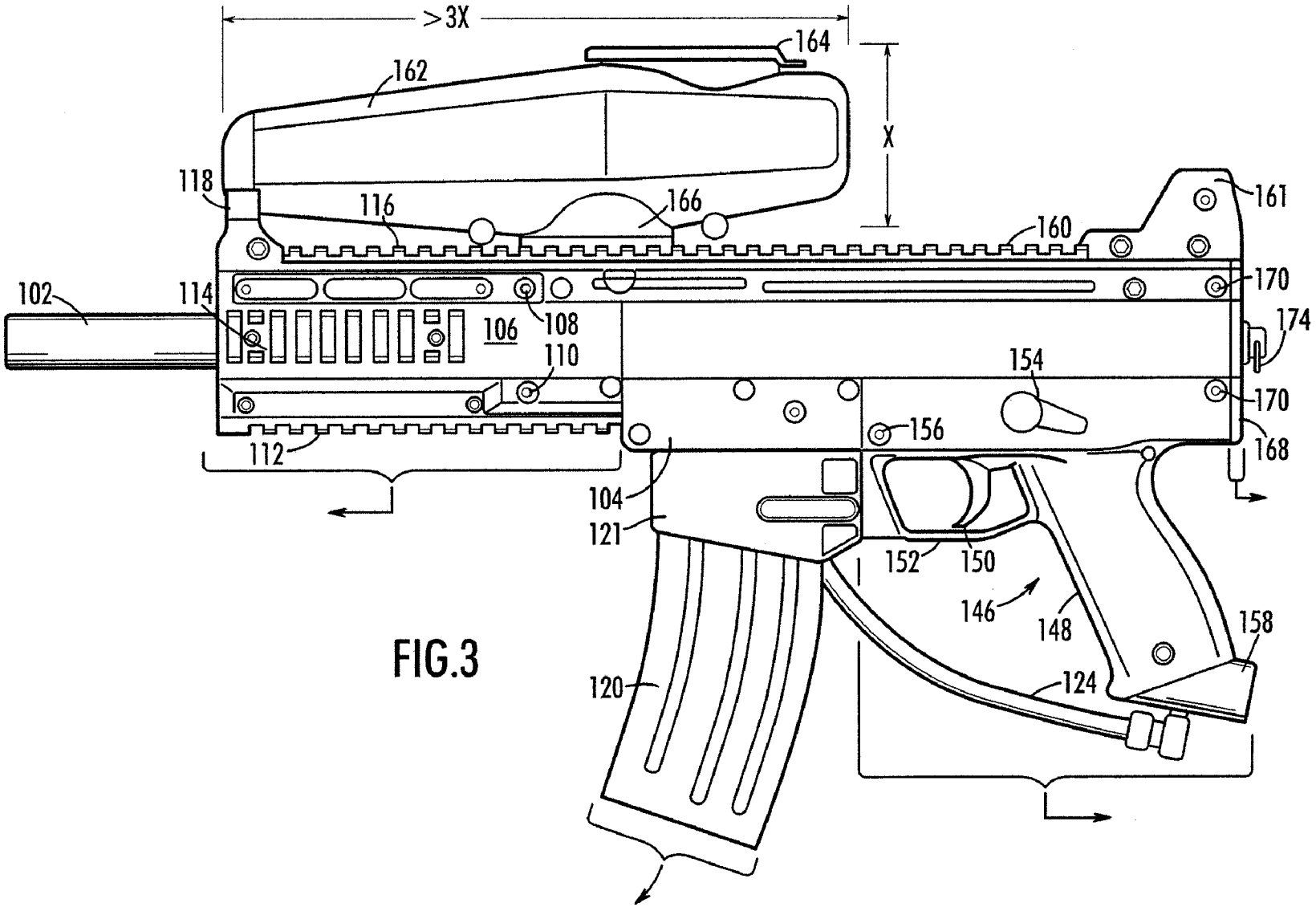
FIG. 3 is a left side view of the example paintball marker shown in FIG. 1.
Figure 4:
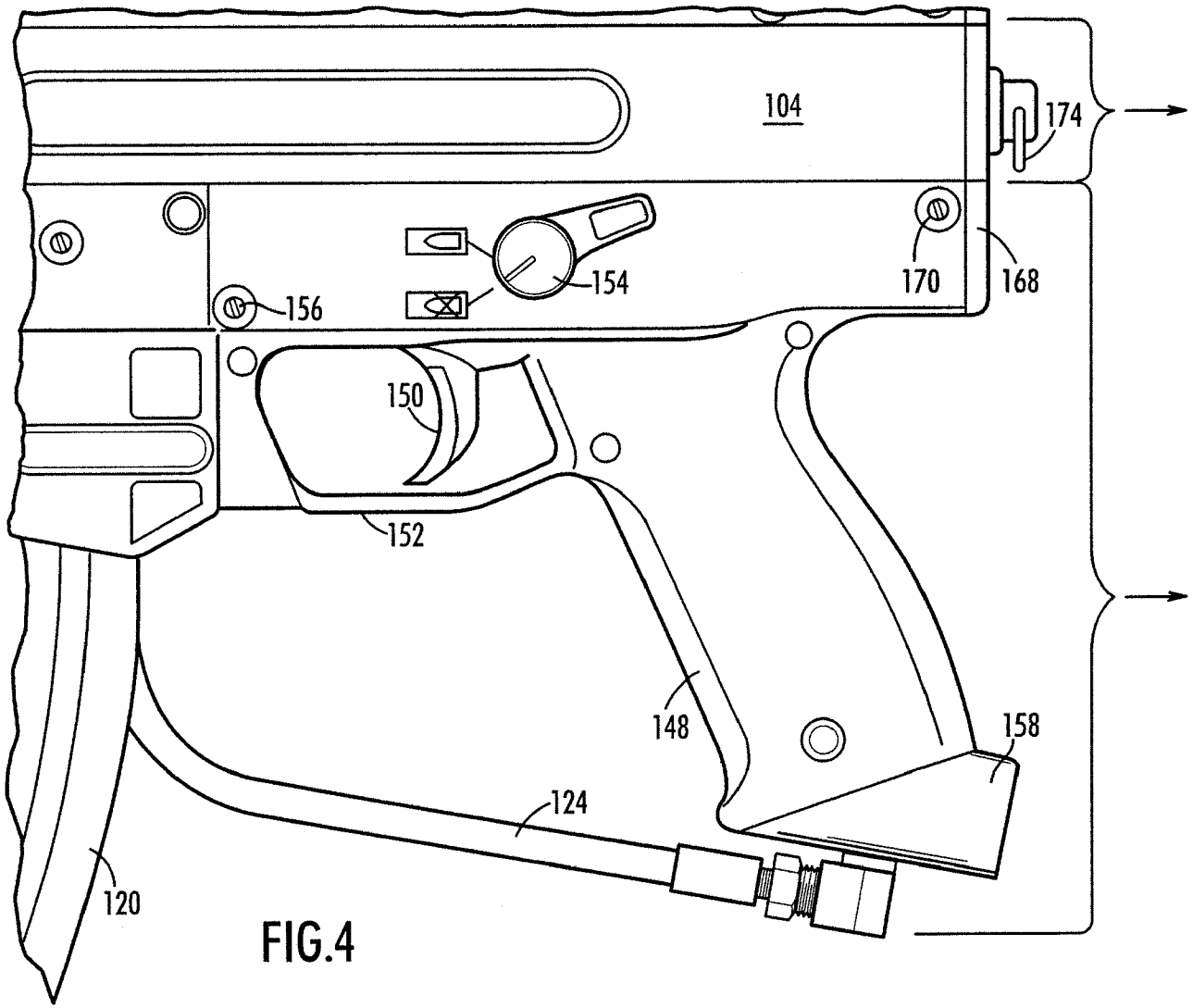
FIG. 4 is a detailed view of the grip assembly for paintball marker shown in FIG. 1.
Figure 5:
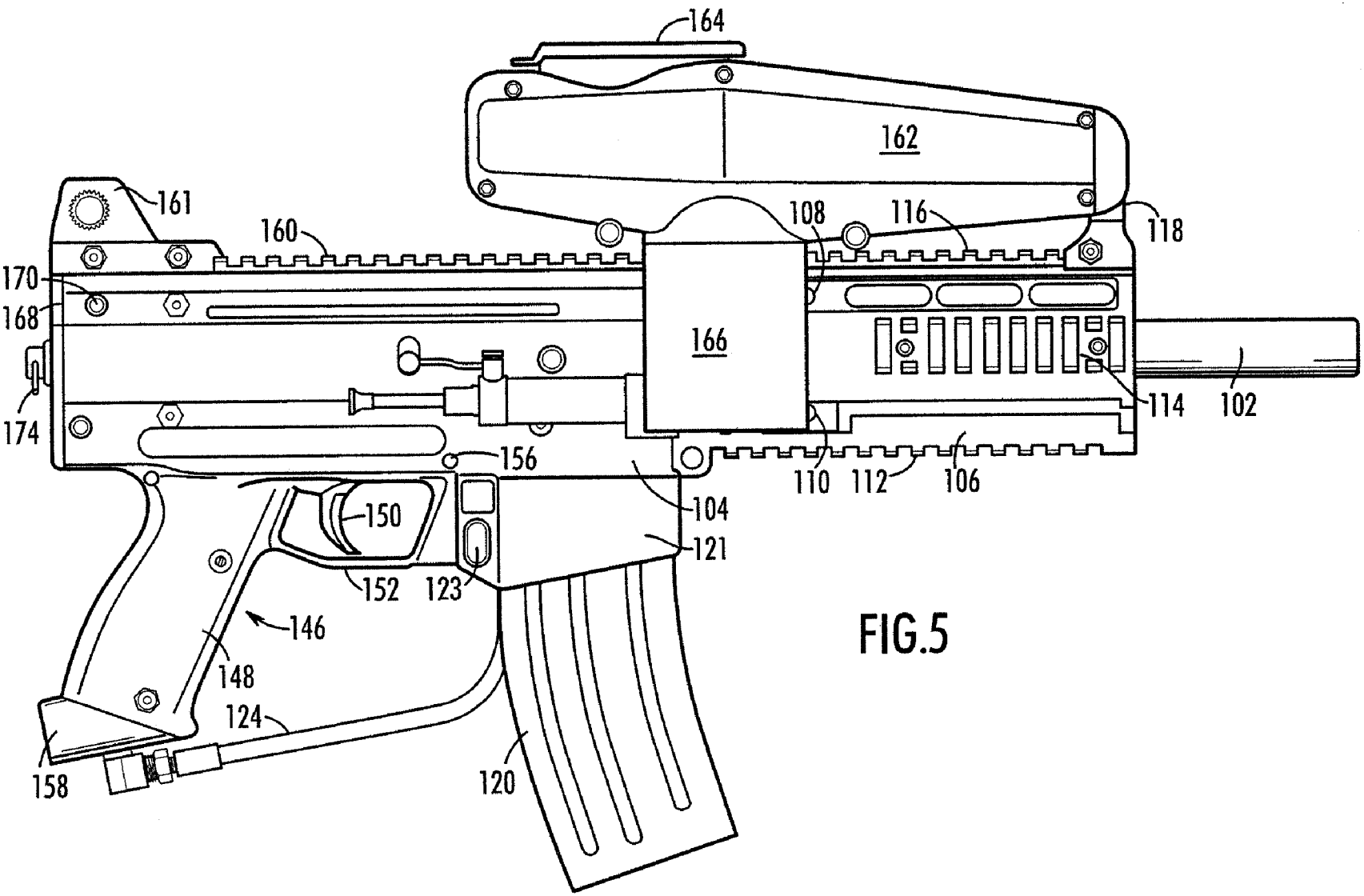
FIG. 5 is a right side view of the example paintball marker shown in FIG. 1.
Figure 6:
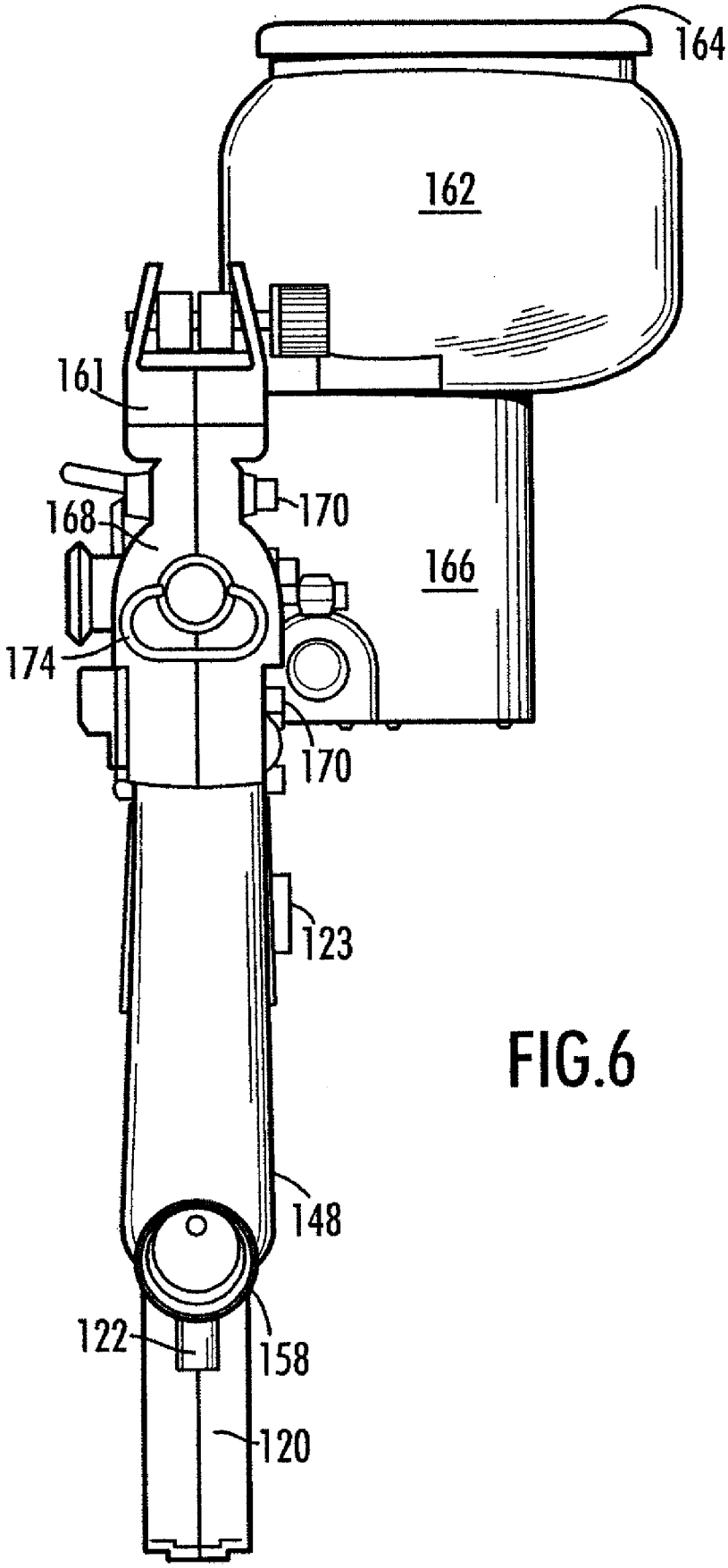
FIG. 6 is a rear view of the example paintball marker shown in FIG. 1.

In the example shown (as best seen in FIG. 2), the tool box mount 121 is coupled with the receiver 104 using an interference fit. As shown, the receiver 104 includes ridges 129 that extend from the receiver 104. The top portion of the tool box mount 121 includes grooves 125 formed in a flange 127 that are configured to receive the ridges 129. To couple the tool box mount 121 to the receiver 104, the user would align the grooves 125 with the ridges 129, such that the ridges 129 extend through the grooves 125. The tool box mount 121 may then be moved toward the barrel 102 in the example shown such that the flange 127 creates an interference fit with the ridges 129. The user may detach the tool box mount 121 by moving the tool box mount 121 in an opposite direction (away from the barrel 102 in this example) until the ridges 129 are aligned with the grooves 125. Other mechanisms, such as a frictional fit, could also be used to couple the tool box mount 121 with the receiver 104.

Preferably, a plurality of interchangeable tool boxes and tool box mounts may be provided to allow customization of the marker 100. Typically, each of the tool boxes includes an interior cavity for storing items, such as tools. Examples of tool boxes that resemble magazines of types used for feeding projectiles into the receivers of actual firearms are shown in FIGS. 20A-20E. It should be appreciated that other styles could also be provided. The tool box 120 may be formed from a variety of materials, including but not limited to plastic, aluminum and magnesium.

The marker 100 may include a grip assembly 146. In the example shown, the grip assembly 146 includes a grip 148 that is dimensioned for a user to grasp. The grip assembly 146 includes a trigger 150 for actuation by the user to fire the marker 100. The trigger 150 may mechanically and/or electrically selectively fire the marker 100. In the example shown, the trigger 150 is surrounded by a trigger guard 152. As shown, the marker 100 includes a safety 154. In the position shown in FIG. 1, the safety 154 prevents the marker 100 from firing; if moved to a fire position, the safety 154 allows the marker 100 to fire projectiles. Although the example shown includes a lever for actuating the safety 154, it should be appreciated that other forms of safety could be used.

In some embodiments, the grip assembly 146 may be detachably coupled with the receiver 104. As shown, the grip assembly 146 includes a hole 155 that is alignable with a hole 157 in the receiver 104 through which a pin 156 may be received. By removing the pin 156 (and the lower pin 170), the grip assembly 146 may be detached from the receiver 104. In the example shown, the lower portion of the grip 148 includes an adaptor 158 configured to receive a propellant source, such as a canister of carbon dioxide or nitrogen. As discussed below, the adaptor 158 and first supply line 124 are optional, depending on whether the rear stock attached to the receiver 104 includes an internal passageway 186 for connection to a propellant source (See FIGS. 15-16).

Figure 21C:
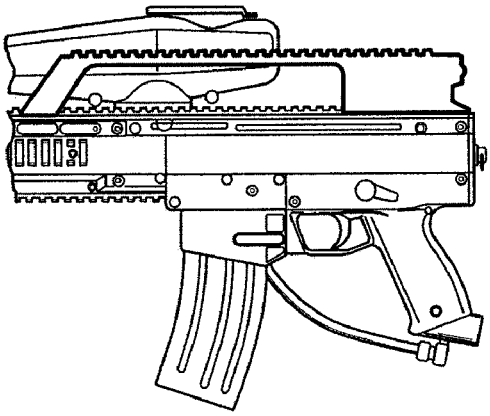
Figure 21D:
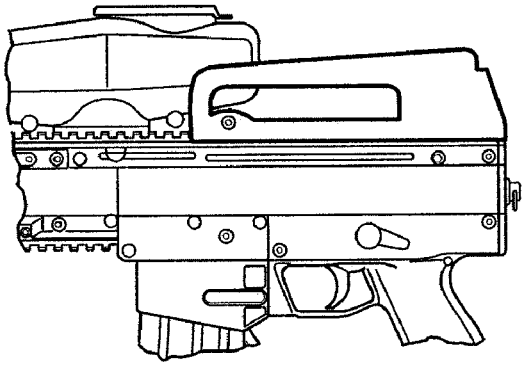

In the example shown, a picatinny rail 160 is attached to a top portion of the receiver 104. The picatinny rail 160 may be used to add risers, sites, handles, or other items to the receiver 104. As shown, a rear sight 161 is coupled to the picatinny rail 160. By way of another example, carry handles, such as shown in FIGS. 21C-21D, could be mounted to the picatinny rail 160.

In the embodiment shown, the marker 100 includes a hopper 162 for holding a plurality of projectiles to be fired. As shown, the hopper 162 includes a lid 164 pivotably mounted to the hopper 162 to selectively open/close an opening to the hopper 162. Preferably the hopper 162 has a low profile to reduce the target area of the user and allow a better line of site to fire the marker 100. By way of example only, the hopper 162 may have a length that is more than three times its height in some cases (see FIG. 3). As shown, the hopper 162 is offset from the receiver 104 to allow a better line of site for the user to fire the marker 100. However, the hopper 162 could be coupled to the receiver 104 on the top (e.g., picatinny rail 160) or other location of the receiver 104.

In some cases, the hopper 162 may be coupled with a feed mechanism 166 that feeds projectiles into the receiver 104. An example feed mechanism that could be used with the marker 100 is shown in U.S. Pat. No. 6,739,323, which is incorporated herein by reference.

Instead of a separate feed mechanism, the hopper 162 may include an integral feed mechanism in some embodiments. For example, the hopper 162 may be an agitating or force-fed hopper. In some cases, the projectiles may be gravity fed into the receiver 104. For example, the lower portion of the hopper 162 may include a passage that is coupled directly with the receiver 104, so that projectiles may be fed one-by-one through the passage into the receiver 104. In some embodiments, the receiver 104 (or other portion of the marker 100) may include an internal cavity for receiving a plurality of projectiles. By way of another example, the receiver 104 may be stick fed with projectiles.

Figure 18A:
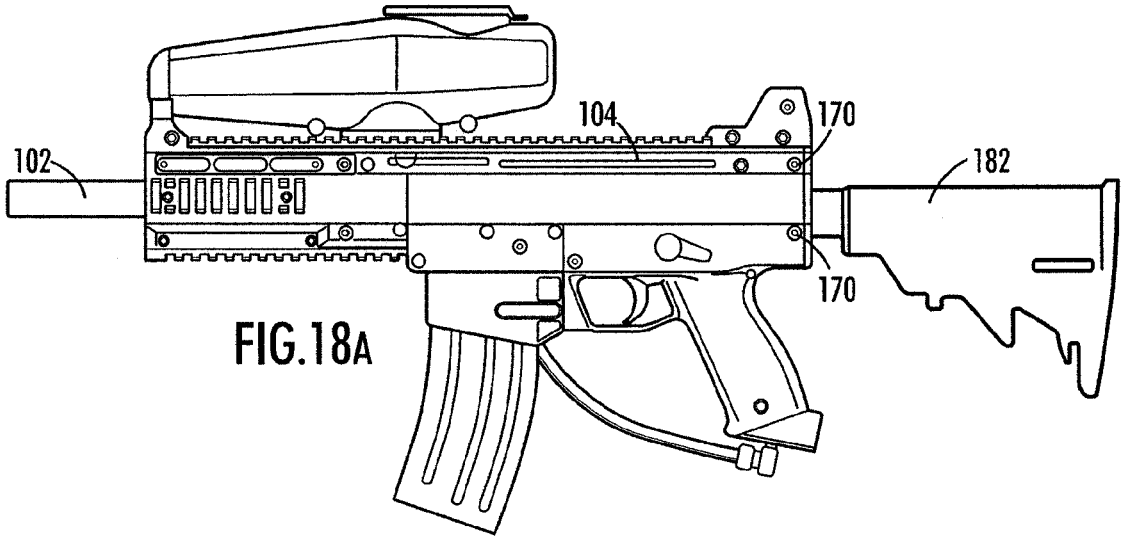
FIGS. 18A-18C show example rear stocks that may be attached to the marker.
Figure 18B:
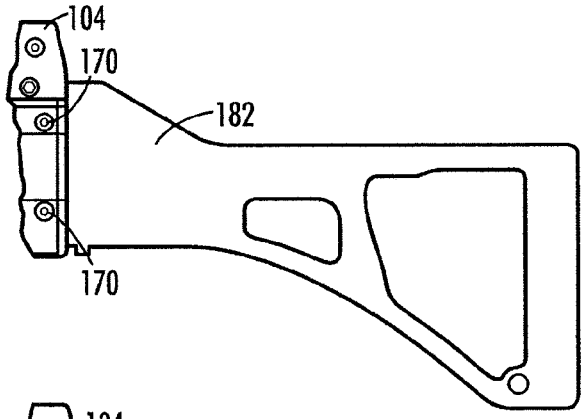
Figure 18C:
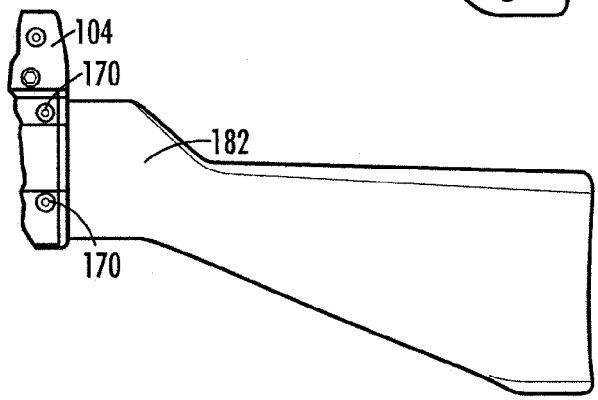
Figure 19A:
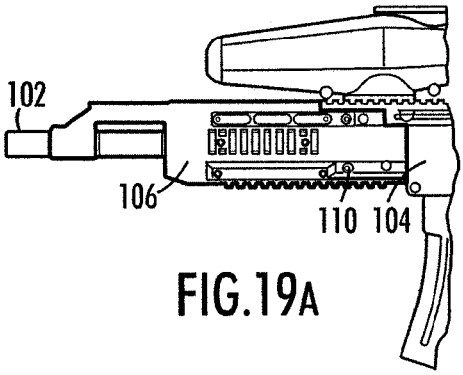
FIGS. 19A-19E show example forestocks that may be attached to the marker.
Figure 19B:
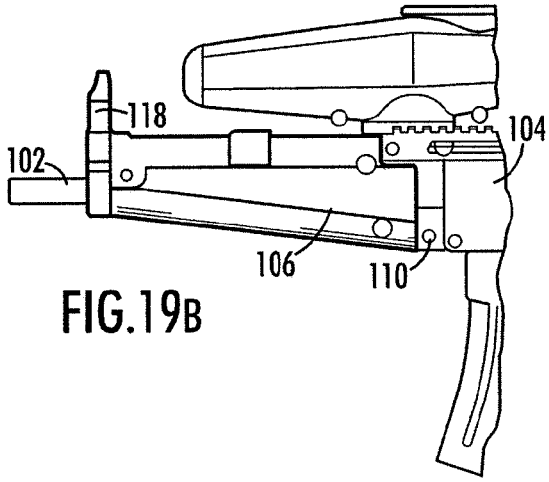
Figure 19C:
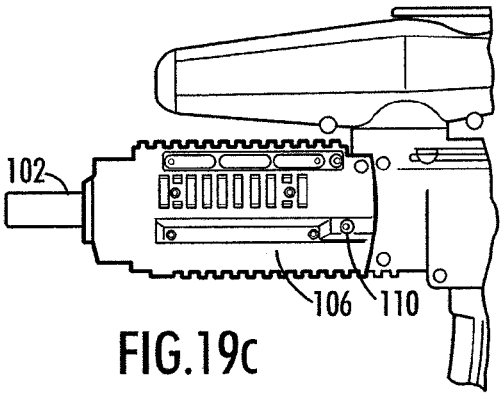
Figure 19D:
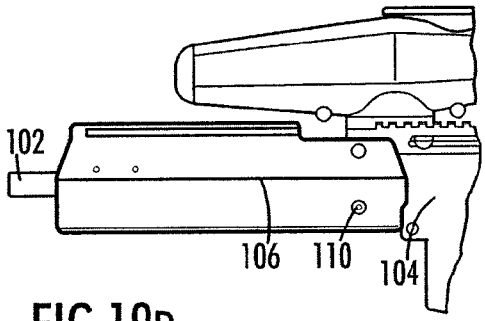
Figure 19E:
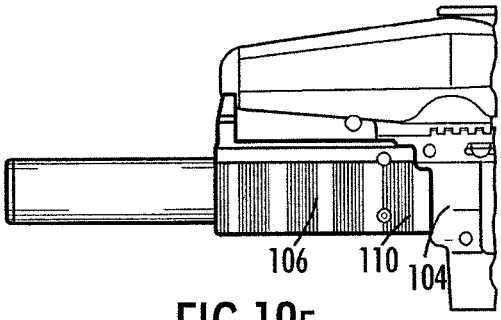
Figure 20A:
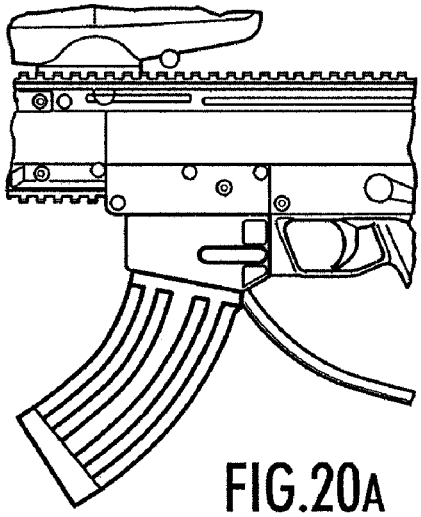
FIGS. 20A-20E show example tool boxes that resemble magazines.
Figure 20B:
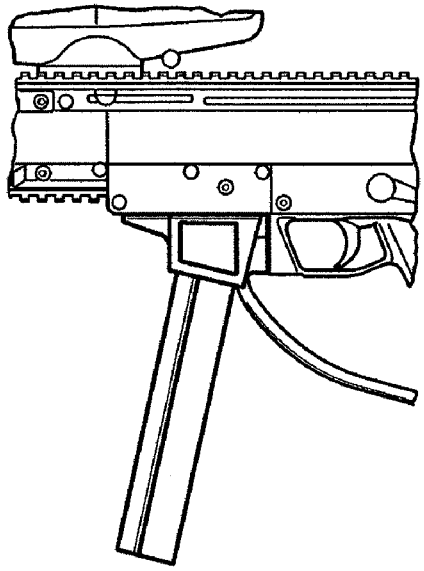
Figure 20C:
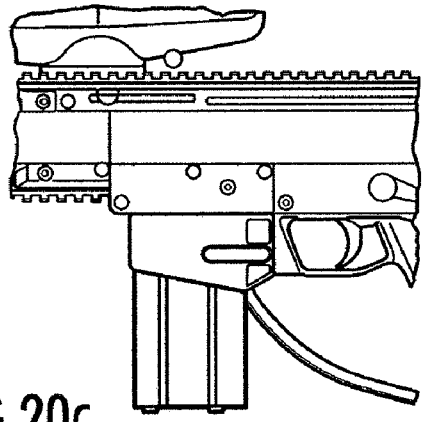
Figure 20D:
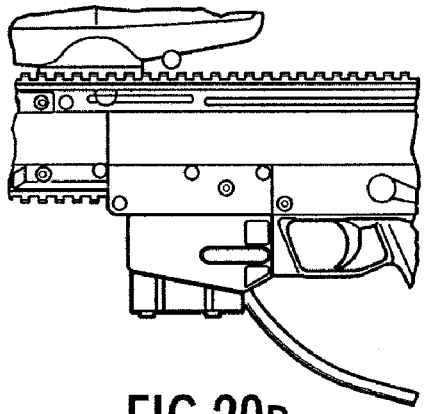
Figure 20E:
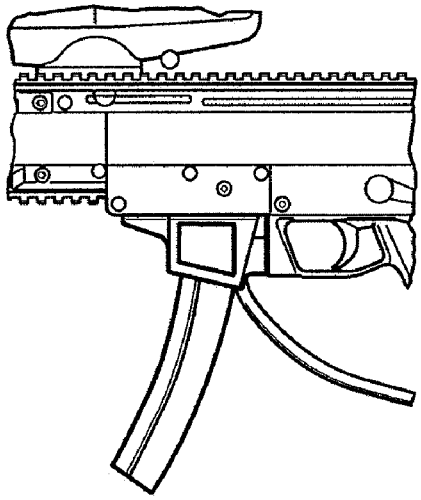

In the embodiment shown in FIGS. 1-9, the marker 100 includes a detachable end cap 168. If the user desires to have a rear stock, the end cap 168 may be removed and a rear stock coupled to the receiver 104 (see FIGS. 14-16). In the example shown, pins 170 pass through projections 172 (see FIGS. 2 and 13) in the end cap 168 and holes in the receiver 104 and grip assembly 146. Removal of the pins 170 allows the user to detach the end cap 168 from the receiver 104. In the example shown, the end cap 168 includes an optional ring 174 that user may grasp to remove the end cap 168. As discussed below, a plurality of interchangeable rear stocks may be substituted for the end cap 168 to customize the marker 100. Preferably, each of the rear stocks include similarly arranged holes such that the rear stocks may be attached to the receiver 104 using the pins 170. Examples of rear stocks that could be used with the marker 100 are shown in FIGS. 18A-18C.

Figure 13:
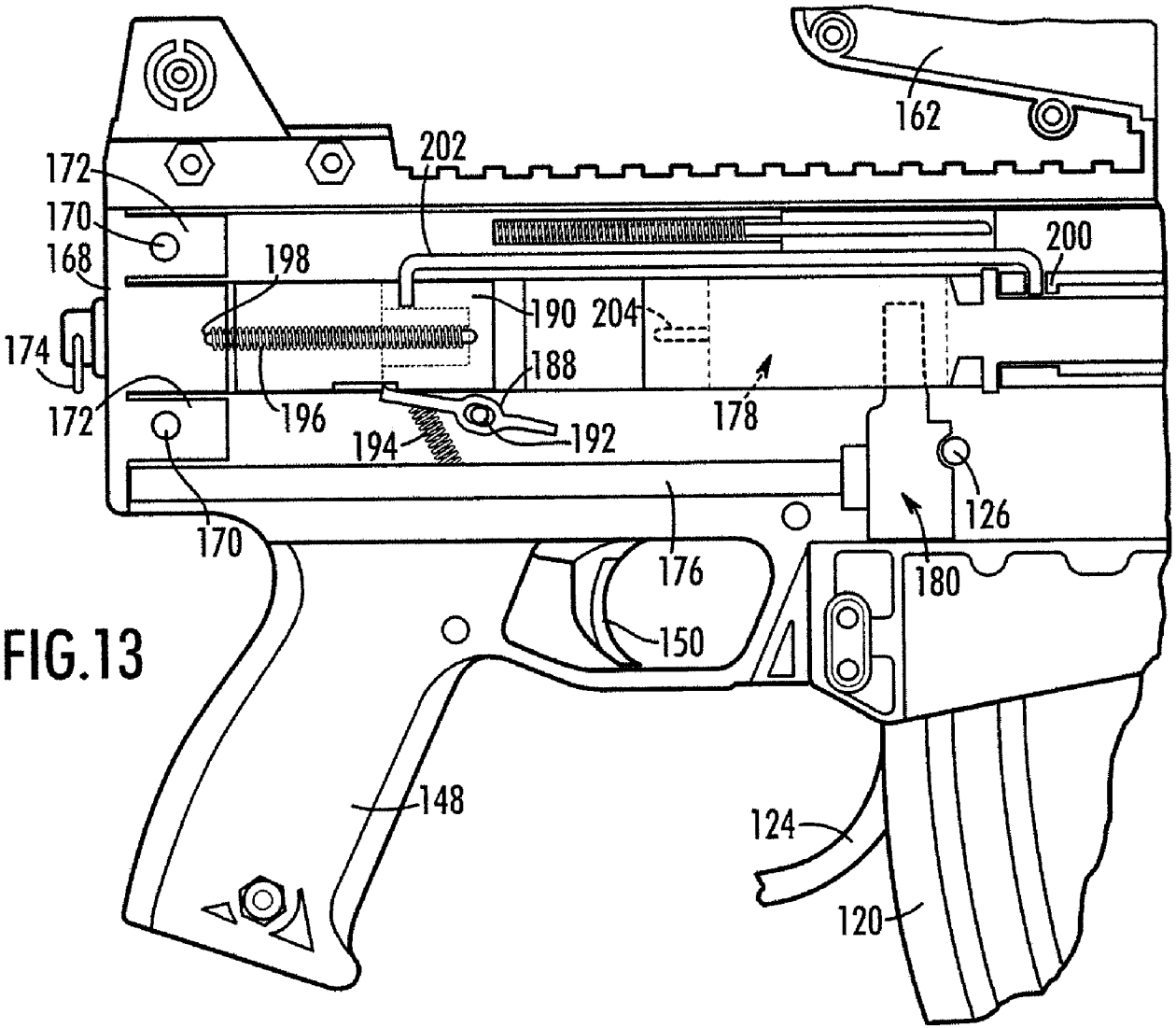
FIG. 13 is a side cross-sectional view showing the first and second supply lines in the example paintball marker of FIG. 1.

Referring now to FIG. 13, there is shown a detailed cross-sectional view of the marker 100. As shown, a sear 188 is interposed between the trigger 150 and a rear bolt 190. In this example, the sear 188 is disposed on pivot pin 192 and is biased by spring 194 toward engagement of the rear bolt 190. When the marker 100 is in the cocked position, actuation of the trigger 150 releases the rear bolt 190 from the sear 188. In the example shown, the marker 100 is in the cocked position when the rear bolt 190 is in a rearward position in which the sear 188 prevents forward movement of the rear bolt 190. In the example shown, the marker 100 moves to a discharge position by releasing of the rear bolt 190 from the sear 188 due to user actuation of the trigger 150. It should be appreciated that other trigger assemblies, both mechanical and electrical, may be suitable to selectively fire the marker 100 and are contemplated herein.

In the example shown, the rear bolt 190 moves under the bias of drive spring 196 upon actuation of the trigger 150. A pin 198 is disposed within the spring 196 in the example shown. The rear bolt 190 is coupled to a front bolt 200 via a linkage arm 202 in the example shown. This causes concomitant movement of the front bolt 200 with the movement of the rear bolt 190. The front bolt 200 is adapted to push a projectile into the barrel 102 during firing.

The bias of drive spring 196 on rear bolt 190 causes rear bolt 190 to depress an impact pin 204 on the valve assembly 178, which causes the valve assembly 178 to release a quantity of compressed gas, thereby causing a projectile to be propelled out the barrel 102. Another quantity of compressed gas may be released on the side of valve assembly 178 in which the rear bolt 190 is disposed, which will recoil the rear bolt 190 to the cocked position. Example valve arrangements and firing mechanisms that could be used are shown and described in U.S. Pat. Nos. 4,189,609, 5,722,383, and 6,550,468, which are each hereby incorporated by reference.

In the embodiment shown, a second supply line 176 can be seen. Preferably, the marker 100 may be configured such that either the first supply line 124 or the second supply line 176 may supply the valve arrangement 178 with a propellant with which the projectiles may be fired. Preferably, the first supply line 124 or the second supply line 176 provides compressed gas, such as carbon dioxide or nitrogen, to the valve arrangement 178. As discussed above, however, the supply lines 124 or 176 could provide fluid communication with a supply of combustible fuel in some embodiments.

In this example, the marker 100 includes a coupling 180 associated with the first supply line 124. Typically, the user would choose between the first supply line 124 and the second supply line 176. If the user decided to use the first supply line 124, the user would put the first supply line 124 and coupling 180 associated with the first supply line 124 into the receiver. This would supply compressed gas to the valve arrangement 178 via the first supply line 124. A passageway is defined in the receiver 104 for receiving the second supply line 176. Preferably, the passageway extends from the valve arrangement to the rear portion of the receiver 104 so that the second supply line 176 may be aligned with a passage with a rear stock which is in fluid communication with a supply of compressed gas. If the user desired to use the second supply line 176, the first supply line and associated coupling 180 would typically be removed and the second supply line and an associated coupling 180 inserted into the passageway. The coupling 180 provides the valve arrangement 178 with a supply of compressed gas from the first supply line in the example shown.

In some cases, the coupling 180 may be configured to receive both the first supply line 124 and the second supply line 176. For example, the coupling 180 may include a first check valve (not shown) at the inlet of the first supply line 124 into the coupling 180 and a second check valve (not shown) at the inlet of the second supply line 176 into the coupling 180. With this arrangement, the inlets would only be open due to the supply of compressed gas to open a respective check valve. It should be appreciated that other mechanisms, both mechanical and electrical, could be used to selectively supply the valve arrangement 176 with a flow of compressed air from either the first supply line 124 or the second supply line 176. In some embodiments, the coupling 180 could be configured to supply compressed air from both the first supply line 124 and the second supply line 176. In the example shown in FIG. 13, the second supply line 176 does not supply compressed gas to the valve arrangement 178 due to the end cap 178 being connected to the receiver 104. As discussed below, the second supply line 176 may continue flow through the rear stock, which may be connected with a source of compressed gas.

Figure 14:
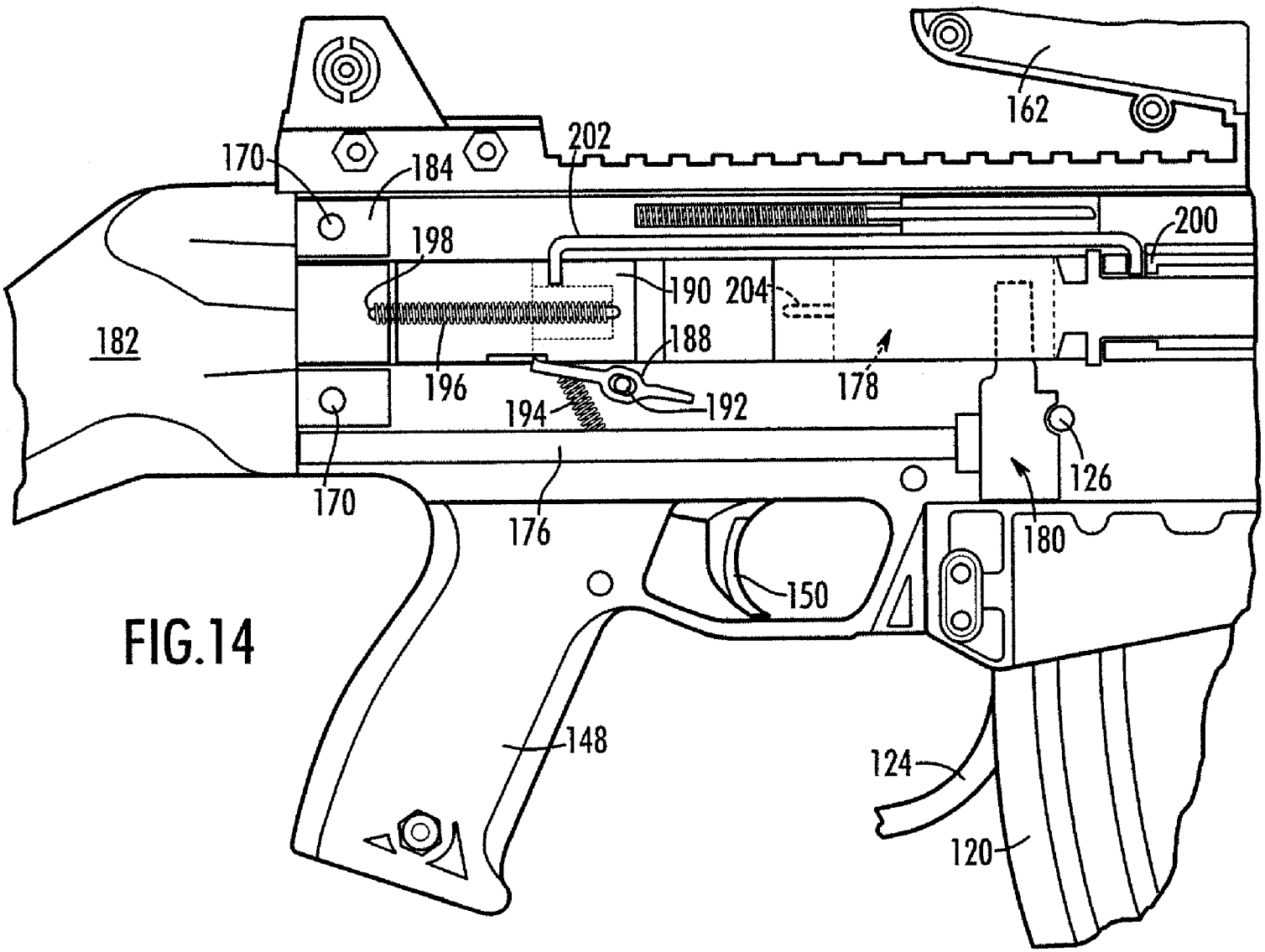
FIG. 14 is a side cross-sectional view showing the second supply line portion of the example paintball marker shown in FIG. 1, with an example rear stock attached to the marker.

FIG. 14 shows an example in which a rear stock 182 has been coupled with the receiver 104. In the example shown, the rear stock 182 includes a projection 184 with holes dimensioned to receive the pins 170. Accordingly, a user may customize a marker 100 with a plurality of interchangeable rear stocks that may be coupled to the receiver 104. Examples of rear stocks that may be coupled to the marker 100 are shown in FIGS. 18A-18C. It should be appreciated that other types of rear stocks could also be provided.

Figure 15:
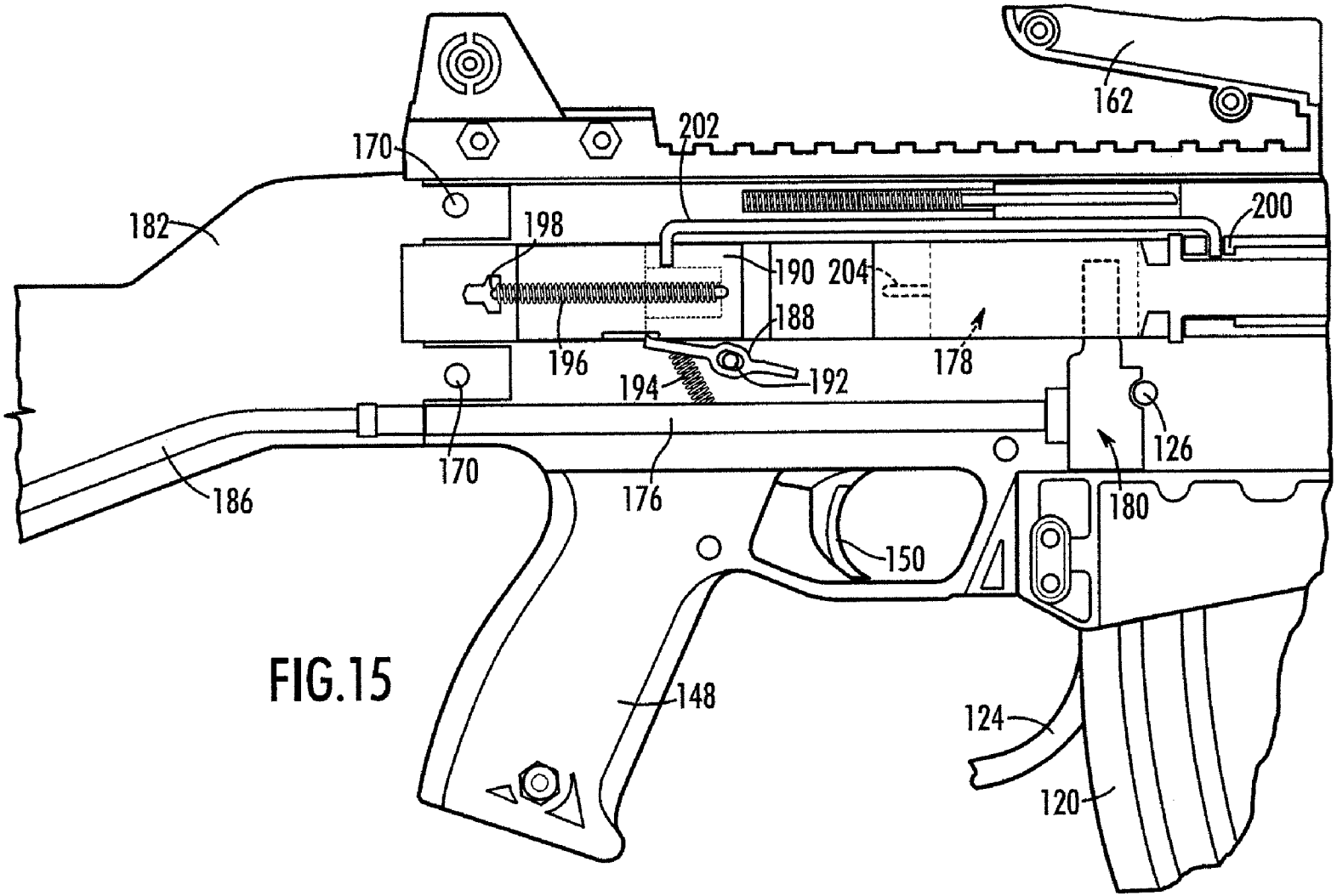
FIG. 15 is a cross-sectional view of the example paintball marker shown in FIG. 14, with a cross-sectional view of an example rear stock attached to the marker.
Figure 16:
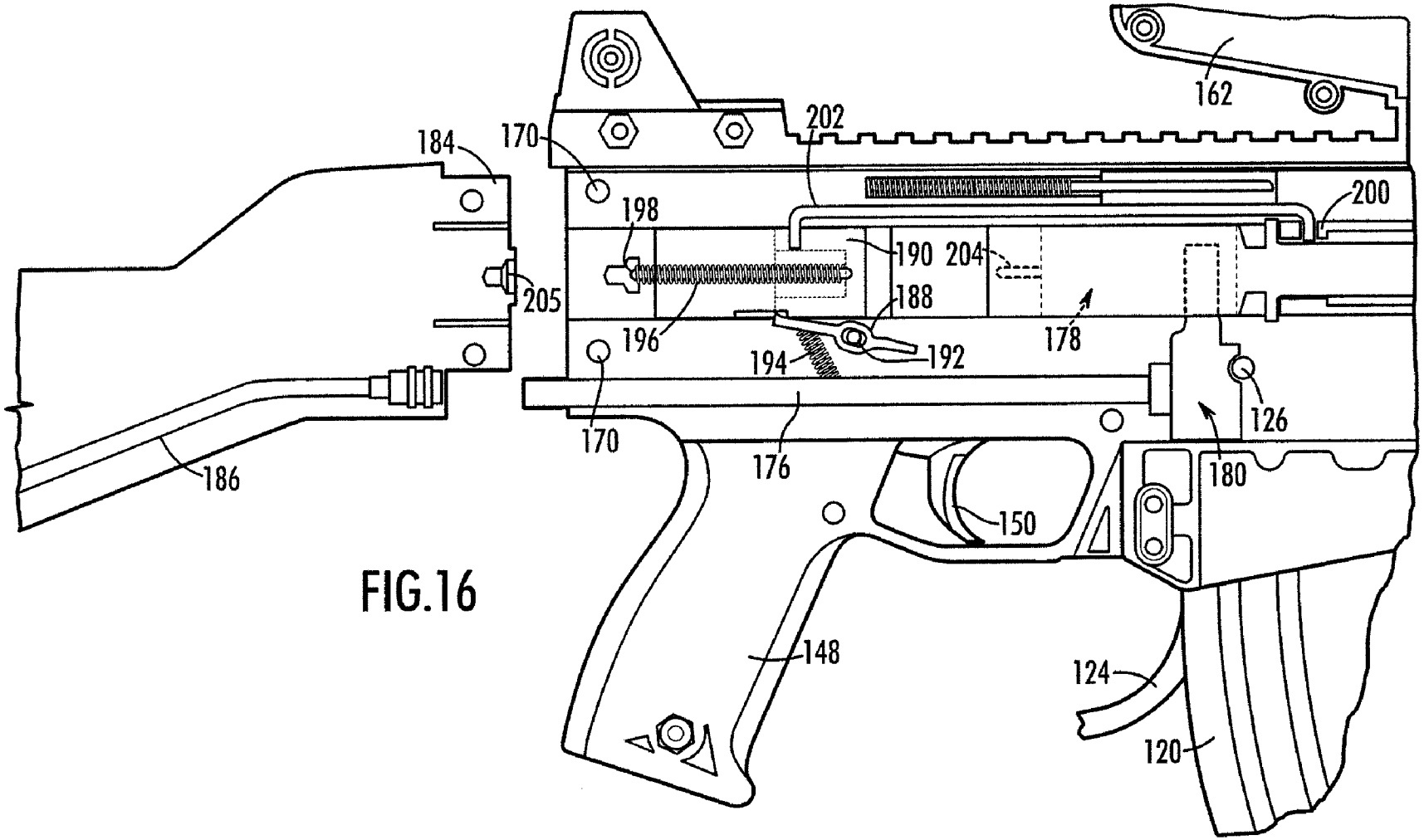
FIG. 16 is a cross-sectional view of the example paintball marker shown in FIG. 15, with the rear stock detached from the marker.

FIGS. 15-16 show the example embodiment of FIG. 14 with the rear stock 182 shown in sectional view. As shown, the rear stock 182 includes a passageway 186 that is in fluid communication with the second supply line 176. The passageway 186 may be in fluid communication with the supply of compressed gas (or other propellant), thereby providing compressed gas to the valve arrangement 178. In some cases, the rear stock 184 may include a recess 205 for receiving an end of the pin 198.

Figure 17:
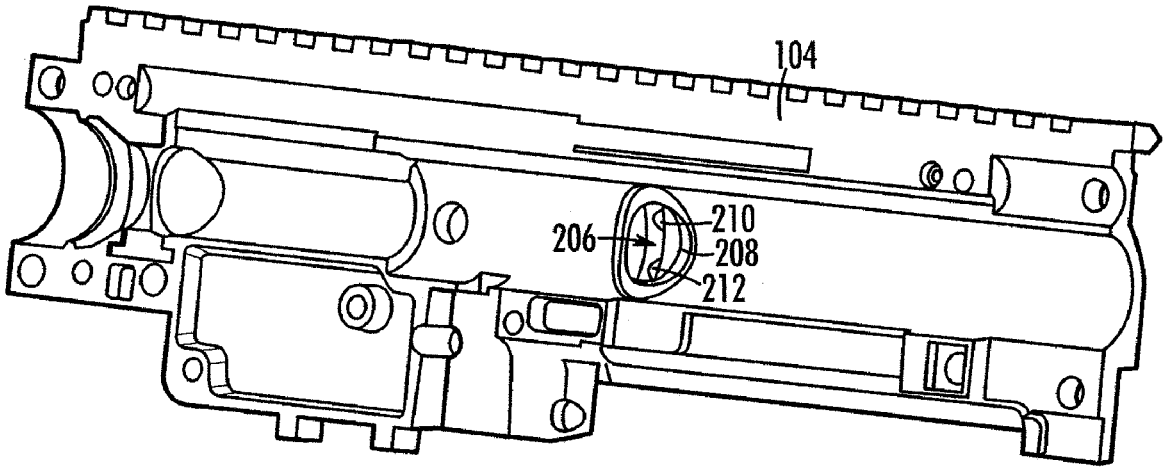
FIG. 17 is a detailed perspective view of a portion of a receiver according to an alternative embodiment.

FIG. 17 shows the right half of an example receiver 104. Although the example receiver 104 shown includes holes that could be used for quick connections of rear stocks, fore stocks, etc., this receiver 104 could also be used with a marker without such customization features. In some cases, the valve assembly 178 may be tapped to supply compressed gas for other functions associated with the marker 100. For example, the feed mechanism 166 could be pneumatically actuated with compressed gas tapped off the valve assembly. For example, U.S. Pat. No. 6,739,323 shows a feed mechanism that may be pneumatically actuated. By way of another example, U.S. Pat. No. 6,550,468 shows a trigger assist that may be pneumatically actuated. In receivers formed by two halves that are connected together, such as the example half shown, gas that is tapped off the valve assembly 178 tends to escape through the seam between the halves of the receiver 104.

In the example shown, the receiver 104 includes a groove 206 dimensioned to receive a seal 208, such as an O-ring. Preferably, the groove 206 is substantially elliptical is shape, which retains the seal 208 without a fastener or adhesive. The groove 206 and seal 208 are disposed within the receiver 104 preferably adjacent the portion of the valve assembly 178 that is tapped to prevent escape of gas through the seam in the receiver 104. As shown, a first outlet port 210 and a second outlet port 212, which are associated with tapped portions of the valve assembly 178, are disposed within the groove. Additionally outlet ports (or a single outlet port) may be provided.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A paintball marker comprising:

a barrel;

a receiver coupled with the barrel;

a hopper configured to provide a supply of projectiles to the receiver;

a valve arrangement configured to selectively vent gas to propel projectiles through the barrel;

a firing mechanism adapted to actuate the valve arrangement;

a tool box with an interior storage compartment, the tool box having a proximate end coupled with the receiver and a distal end extending from the receiver;

wherein the tool box resembles a magazine; and wherein the tool box includes a first member and a second member pivotally coupled about the distal end with at least one living hinge.

2. The paintball marker of claim 1, wherein the tool box is configured to be detachably coupled with the receiver.

3. The paintball marker of claim 1, wherein the tool box is integral with the receiver.

4. The paintball marker of claim 1, wherein at least a portion of the tool box is disposed between the barrel and the firing mechanism.

5. The paintball marker of claim 1, wherein the hopper extends above the receiver and the tool box extends below the receiver.

6. The paintball marker of claim 1, wherein the first member includes an opening dimensioned to receive a latch on the second member.

7. The paintball marker of claim 1, wherein the tool box is substantially formed from plastic.

8. The paintball marker of claim 7, wherein the receiver is substantially formed from magnesium.

9. The paintball marker of claim 1, wherein the receiver includes an internal passageway extending between the valve arrangement and a rear portion of the receiver and wherein the internal passageway is dimensioned to receive a supply line for providing propellant to the valve arrangement.

10. The paintball marker of claim 1, further comprising a safety coupled with the receiver, wherein the safety is configured to rotate between a safe position that prevents actuation of the firing mechanism and a fire position that allows actuation of the firing mechanism.

11. The paintball marker of claim 1, wherein the hopper has a length that is at least three times greater than its height.

12. The paintball marker of claim 1, wherein the tool box includes a slot dimensioned to receive a supply line of propellant.

13. The paintball marker of claim 1, wherein the storage compartment is configured to hold a specific tool.

14. The paintball marker of claim 13, wherein the storage compartment is configured to hold one or more hex wrenches.

15. The paintball marker of claim 14, wherein the storage compartment includes one or more slots dimensioned to hold the hex wrenches.

16. The paintball marker of claim 13, wherein the storage compartment is dimensioned to hold a tube of oil for maintaining the paintball marker.

17. The paintball marker of claim 1, wherein the tool box includes a wall that prevents items from exiting the storage compartment through the proximate end.

18. A paintball marker comprising:

a barrel;

a receiver coupled with the barrel, wherein the receiver includes a first transverse hole extending above the barrel and a second transverse hole extending below the barrel and wherein the first transverse hole and the second transverse hole are dimensioned to receive pins for coupling a forestock to the receiver;

a hopper configured to provide a supply of projectiles to the receiver;

a valve arrangement configured to selectively vent gas to propel projectiles through the barrel;

a firing mechanism adapted to actuate the valve arrangement;

a tool box with an interior storage compartment, the tool box having a proximate end coupled with the receiver and a distal end extending from the receiver; and a plurality of interchangeable forestocks configured to be coupled with the receiver, wherein the forestocks each have a first pin hole and a second pin hole, wherein the first pin hole is configured to be aligned with the first transverse hole when a second pin hole is aligned with the second transverse hole.

19. The paintball marker of claim 18, wherein the tool box is configured to be detachably coupled with the receiver.

20. The paintball marker of claim 18, wherein the tool box is integral with the receiver.

21. The paintball marker of claim 18, wherein at least a portion of the tool box is disposed between the barrel and the firing mechanism.

22. The paintball marker of claim 18, wherein the tool box resembles a magazine.

23. The paintball marker of claim 18, wherein the hopper extends above the receiver and the tool box extends below the receiver.

24. The paintball marker of claim 18, wherein the tool box includes a first member and a second member pivotally coupled about the distal end.

25. The paintball marker of claim 24, wherein the first member and the second member are pivotally coupled with at least one living hinge.

26. The paintball marker of claim 24, wherein the first member includes an opening dimensioned to receive a latch on the second member.

27. The paintball marker of claim 18, wherein the tool box is substantially formed from plastic.

28. The paintball marker of claim 27, wherein the receiver is substantially formed from magnesium.

29. The paintball marker of claim 18, wherein the receiver includes an internal passageway extending between the valve arrangement and a rear portion of the receiver and wherein the internal passageway is dimensioned to receive a supply line for providing propellant to the valve arrangement.

30. The paintball marker of claim 18, further comprising a safety coupled with the receiver, wherein the safety is configured to rotate between a safe position that prevents actuation of the firing mechanism and a fire position that allows actuation of the firing mechanism.

31. The paintball marker of claim 18, wherein the hopper has a length that is at least three times greater than its height.

32. The paintball marker of claim 18, wherein the tool box includes a slot dimensioned to receive a supply line of propellant.

33. The paintball marker of claim 18, wherein the storage compartment is configured to hold a specific tool.

34. The paintball marker of claim 33, wherein the storage compartment is configured to hold one or more hex wrenches.

35. The paintball marker of claim 33, wherein the storage compartment includes one or more slots dimensioned to hold the hex wrenches.

36. The paintball marker of claim 33, wherein the storage compartment is dimensioned to hold a tube of oil for maintaining the paintball marker.

37. A paintball marker comprising:

a barrel;

a receiver coupled with the barrel;

a hopper configured to provide a supply of projectiles to the receiver;

a valve arrangement configured to selectively vent gas to propel projectiles through the barrel;

a firing mechanism adapted to actuate the valve arrangement;

a tool box with an interior storage compartment, the tool box having a proximate end coupled with the receiver and a distal end extending from the receiver, wherein the tool box resembles a magazine; and wherein the tool box includes a first member and a second member pivotally coupled about the distal end.

38. The paintball marker of claim 37, wherein the first member includes an opening dimensioned to receive a latch on the second member.

39. The paintball marker of claim 37, wherein at least a portion of the tool box is disposed between the barrel and the firing mechanism.

40. The paintball marker of claim 37, wherein the hopper extends above the receiver and the tool box extends below the receiver.

41. The paintball marker of claim 37, wherein the tool box is substantially formed from plastic.

42. The paintball marker of claim 41, wherein the receiver is substantially formed from magnesium.

43. The paintball marker of claim 37, wherein the receiver includes an internal passageway extending between the valve arrangement and a rear portion of the receiver and wherein the internal passageway is dimensioned to receive a supply line for providing propellant to the valve arrangement.

44. The paintball marker of claim 37, further comprising a safety coupled with the receiver, wherein the safety is configured to rotate between a safe position that prevents actuation of the firing mechanism and a fire position that allows actuation of the firing mechanism.

45. The paintball marker of claim 37, wherein the hopper has a length that is at least three times greater than its height.

46. The paintball marker of claim 37, wherein the tool box includes a slot dimensioned to receive a supply line of propellant.

47. The paintball marker of claim 37, wherein the storage compartment is configured to hold a specific tool.

48. The paintball marker of claim 47, wherein the storage compartment is configured to hold one or more hex wrenches.

49. The paintball marker of claim 48, wherein the storage compartment includes one or more slots dimensioned to hold the hex wrenches.

50. The paintball marker of claim 47, wherein the storage compartment is dimensioned to hold a tube of oil for maintaining the paintball marker.

51. The paintball marker comprising:

a barrel;

a receiver coupled with the barrel;

a hopper configured to provide a supply of projectiles to the receiver;

a valve arrangement configured to selectively vent gas to propel projectiles through the barrel;

a firing mechanism adapted to actuate the valve arrangement;

a tool box with an interior storage compartment, the tool box having a proximate end coupled with the receiver and a distal end extending from the receiver; and a tool box mount dimensioned to receive the tool box, wherein the tool box mount includes a latch mechanism configured to selectively release the tool box from the toot box mount.

52. The paintball marker of claim 51, wherein the tool box mount includes a button that actuates the latch mechanism.

53. The paintball marker of claim 51, wherein the tool box mount is coupled with the receiver using an interference fit.

54. The paintball marker of claim 53, further comprising a ridge extending from the receiver, wherein the tool box mount includes a groove formed in a flange that is alignable with the ridge.

55. The paintball marker of claim 51, wherein the tool box mount includes a slot dimensioned to receive a supply line of propellant.

* * * * *